US006512433B1

(12) United States Patent
Bouchard et al.

(10) Patent No.: US 6,512,433 B1
(45) Date of Patent: Jan. 28, 2003

(54) PROTECTION RELAY AND PROTECTED CONTROL SET WITH FRONT WIRING

(75) Inventors: Denis Bouchard, Varois-et-Chaignot (FR); Daniel Sinthomez, Pont-de-Pagny (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/979,054

(22) PCT Filed: May 19, 2000

(86) PCT No.: PCT/FR00/01393

§ 371 (c)(1),
(2), (4) Date: Nov. 16, 2001

(87) PCT Pub. No.: WO00/72349

PCT Pub. Date: Nov. 30, 2000

(30) Foreign Application Priority Data

May 20, 1999 (FR) ..... 99 06450

(51) Int. Cl.[7] ..... H01H 9/02; H01H 13/04; H01H 67/02

(52) U.S. Cl. ..... 335/6; 335/13; 335/132; 335/156; 335/159; 335/202; 200/293; 200/294

(58) Field of Search ..... 335/6–8, 11, 13, 335/21, 132, 202, 156, 159–163; 200/293–307

(56) References Cited

U.S. PATENT DOCUMENTS

| | | | | |
|---|---|---|---|---|
| 4,788,621 A | * | 11/1988 | Russell et al. | 361/115 |
| 5,362,933 A | | 11/1994 | Kutsche et al. | 200/401 |
| 5,539,168 A | | 7/1996 | Linzenich | 200/303 |
| 5,875,885 A | * | 3/1999 | Changle et al. | 200/293 |

FOREIGN PATENT DOCUMENTS

| | | |
|---|---|---|
| DE | G 91 08 605.1 | 11/1991 |
| EP | 0 256 900 A1 | 2/1988 |
| EP | 0 828 270 A2 | 3/1998 |
| EP | 0 828 270 A3 | 3/1998 |
| EP | 0 881 727 A3 | 12/1998 |
| EP | 0 881 727 A2 | 12/1998 |

* cited by examiner

*Primary Examiner*—Ramon M. Barrera
(74) *Attorney, Agent, or Firm*—Parkhurst & Wendel, L.L.P.

(57) ABSTRACT

The invention concerns a protection relay, in particular of the thermal type, recessed relative to its front face (24), a recess acting as through passage for interconnection of the conductors (C) between the terminals of the relay control (23) and of the contact switch (16). The recess (27) is concealed in normal operation by a shutter consisting of a flap (26) or a fixed part (26') of the housing (20). The interconnection conductors can consist of individual cables (C) or can be integrated to a precabling addition (40) housed in the recess.

9 Claims, 3 Drawing Sheets

PROTECTION RELAY AND PROTECTED CONTROL SET WITH FRONT WIRING

FIELD OF THE INVENTION

This invention relates to a protection relay, and particularly a thermal relay, capable of being connected to a contactor and including a box provided with power connection terminals on the input and output sides, and control terminals, and provided on the front with manually operated devices for actuation or adjustment. As is well known, the power terminals on the input side and the control terminals of this type of protection relay must be connected to the corresponding power and control terminals of an adjacent contactor.

The invention relates also to a protected control set including such a protection relay.

BACKGROUND OF THE INVENTION

Documents EP-256 900 and EP-828 270 disclose thermal protection relays in which the box is provided with a flap that can fold down on selection, control or adjustment devices that must remain inaccessible in normal service, by pivoting or by sliding. The flap leaves a stop button and a reset button accessible at all times. The operator can thus use the stop button to freely cut off the power line through a contactor, the coil of which is connected to the thermal relay or through the reset button, he can manually reset the thermal relay into its operation state after it has tripped. On the other hand, the operator can only take action on the adjustment button or on the manual/automatic mode switch (H/A) when the flap is opened.

The power interconnection between the relay and the contactor remains hidden as long as the two devices are assembled. On the other hand, the control interconnection that the user has to make between the relay control terminals and the contactor control terminals leaves the conductors on the front of the equipment visible and accessible to be manipulated. This can be a serious problem.

The purpose of the invention is to provide a masked control interconnection for the relay and the contactor using simple means.

SUMMARY OF THE INVENTION

According to the invention, the relay box includes at least one recess setback from its front face used for the passage of an interconnection conductor between a relay control terminal and a contactor control terminal, the said recess being masked in normal service by a cache, or cover, and housing part of a prewiring additive, or accessory, provided with the interconnection conductor(s), on the front.

The cache may be a flap that enables and prohibits operation of an actuation device or a limited access adjustment device, when in the open or closed position respectively. Alternatively, the cache may simply be a fixed part of the protection relay box.

The prewiring addition may be housed in the recess, either when the recess is provided on the front of the protection relay box that can be concealed by a flap, or when the recess is provided in a fixed part of the box setback from this front face.

The invention also relates to a protected control set formed by the protection relay and the contactor laid out and interconnected as described above.

BRIEF DESCRIPTION OF THE DRAWINGS

We will now describe a non-limitative embodiment of the invention with reference to the attached drawings.

DESCRIPTION OF THE PREFERRED EMBODIMENTS

Figure 1:
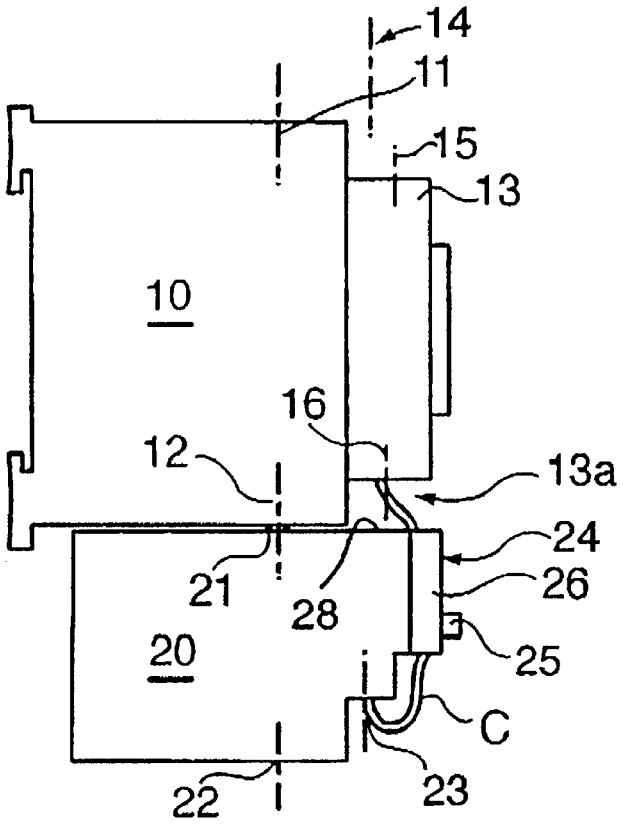
FIG. 1 shows a side view of a protected electrical control set composed of a contactor and a thermal type protection relay.

The control and protection set shown includes a contactor with a box 10 and a thermal protection relay with a box 20 assembled to the contactor. The box 10 of the contactor is provided with input power terminals 11 and output power terminals 12, and a control—instrumentation terminal block 13 on the front side, in other words on the side accessible to the user. The term control used later in this description refers indifferently to the instrumentation (or signalling) and the control (or switching) function that changes the state of the contactor by energizing the contactor coil. The control terminal block 13 projecting forwards beyond the front face 14 of the box 10 on which openings are formed through which a tool can access the terminals 11, 12 is provided with input side control terminals 15 and output side control terminals 16 that can be connected to a high potential and a low potential respectively.

The box 20 of the thermal relay is provided with input power terminals 21 consisting of pins that can enter into the contactor output terminals 12. This box 20 is also provided with output power terminals 22 to be connected to a load, and control terminals 23 to be connected to some of the output control terminals 16 of the box 10 using rigid or flexible conductors C, and that may be connected to signalling devices. These conductors are laid out to be mechanically connected to each other in the form of additional prewiring. Note that the terminals 23 are located on the output side, on the side opposite to the contactor.

The main face of the box 20 is provided with limited access devices 24, particularly with actuation or adjustment functions, and permanent access devices 25, particularly with a stop and/or reset function. The limited access devices 24 may for example be an adjustment button 24*a* and a selection button 24*b* to select the operating mode (manual or automatic) of the relay, and permanent access devices 25 may for example be a reset and stop button or two separate buttons performing these functions.

Figure 2:
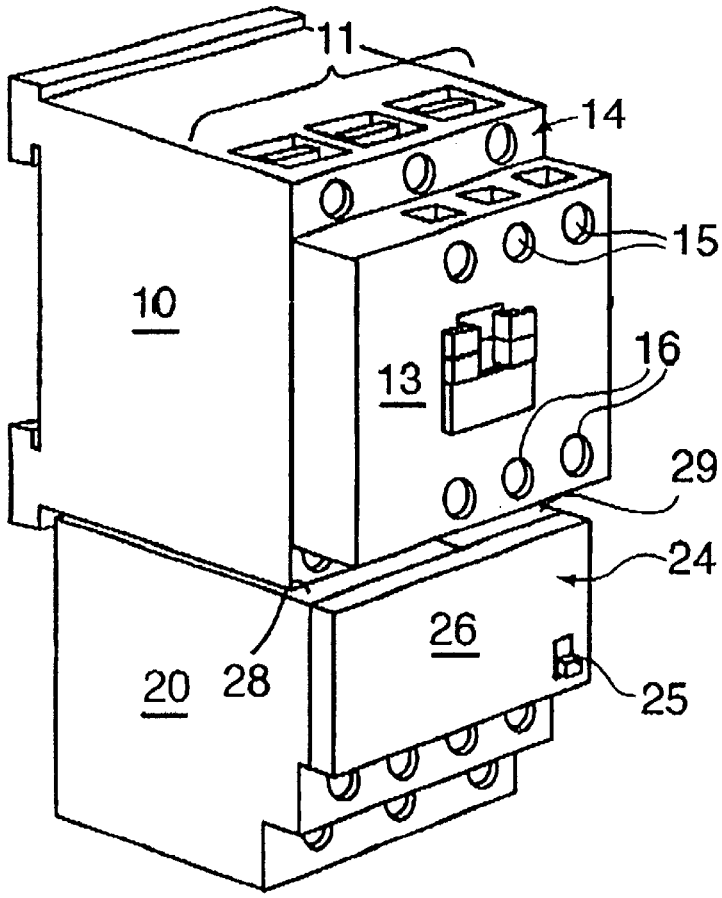
FIG. 2 shows a perspective view of the set in FIG. 1.
Figure 3:
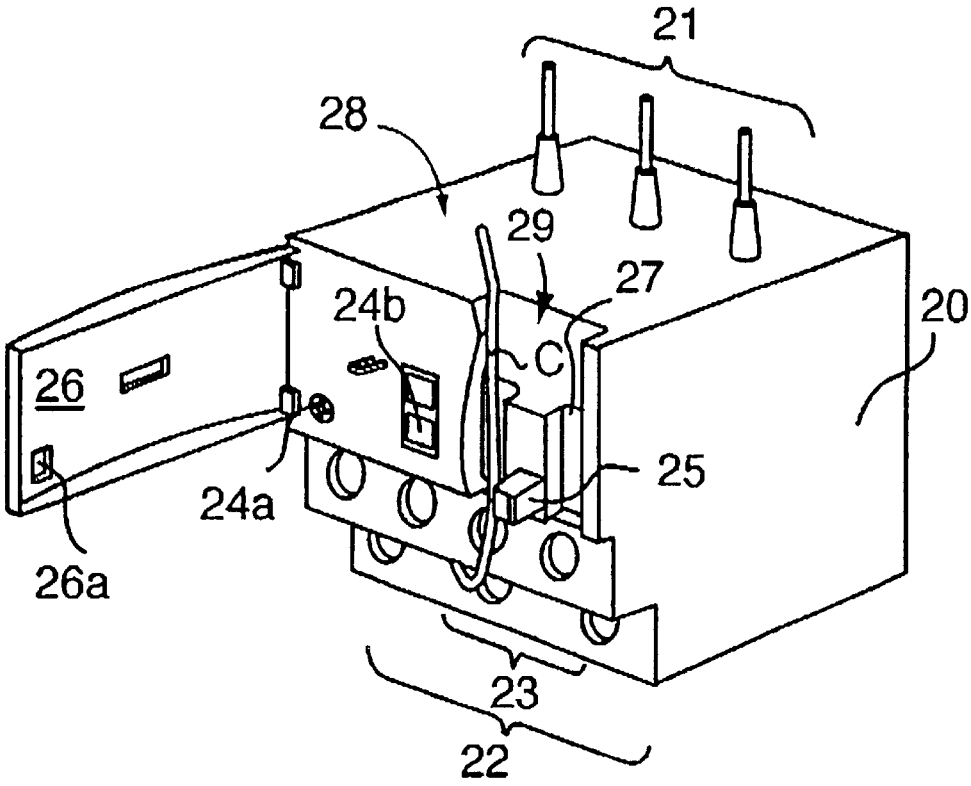
FIGS. 3 and 4 show perspective views of the protection relay with its flap open, without a prewiring additive and with a prewiring additive respectively.

The box 20 also includes a flap 26 forming its front face 24. The front face 24 would obviously be fixed if there were no such flap. The flap 26 enables access to devices 24 when in the open position (see FIGS. 3, 4 and 5) and prohibits access to these devices when in the closed position (see FIGS. 1, 2 and 6). It includes an opening 26*a* that can be used to access devices 25 at all times. The flap 26 is able to fold down on devices 24, 25 by pivoting or sliding with respect to box 20.

A recess is provided setback from the front 24 of the box 20 of the thermal relay, such as a channel 27 designed to carry two conductors, and for example including two separate passageways on each side of the stop and reset button 25. The channel is located close to the right of the box so that its passageways are approximately at the same level as the two control terminals 23 of the relay. The channel 27 is formed in the box 20 or in the flap 26 and opens up on the flat top surface 28 of the box 20 adjacent to the contactor through a flared opening 29 through which the conductors can easily pass towards the corresponding output terminals 16-A2 and 16-14 of the contactor. The opening 29 leads to a space 13*a* open towards the front and delimited by the control terminal block 13, the front 14 of the contactor and the top surface 28 of the relay.

Figure 4:
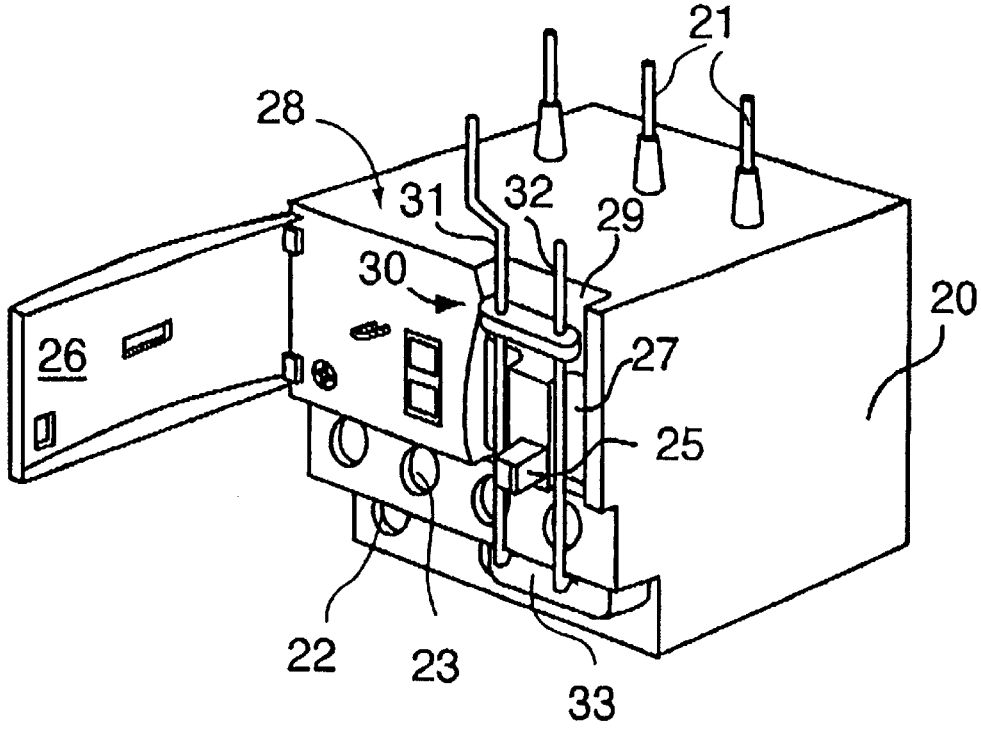
Figure 5:
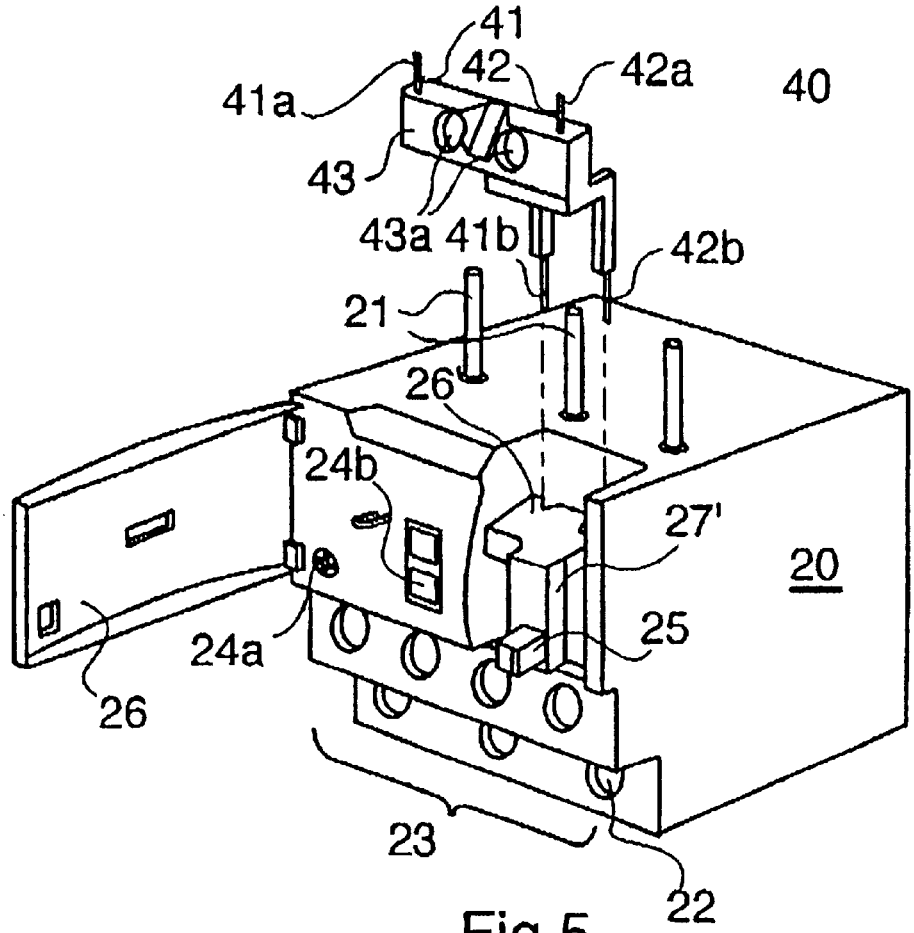
FIGS. 5 and 6 show perspective views of a variant embodiment of the protection relay, provided with a prewiring additive with the flap open and closed respectively, the prewiring additive being shown before and after its installation respectively.
Figure 6:
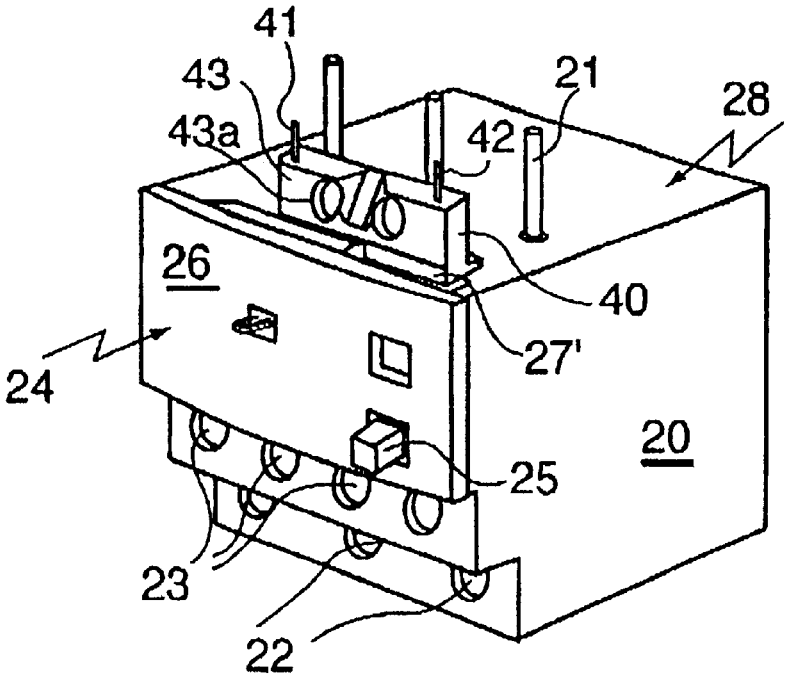

The thermal relay is also laid out so that an additional control prewiring subset provided with interconnection conductors can be fitted on the front;

the addition is shown in a first variant in FIG. 4 and in a second variant in FIGS. 5 and 6.

The prewiring addition 30 shown in FIG. 4 is housed in the channel 27 and includes two approximately rigid interconnection conductors 31, 32; in their lower part, the conductors 31, 32 are connected by an insulating mounting 33 and can fit into the terminals 23 on the opposite side of the contactor; at their top, they are bent to penetrate into the terminals 16 of the contactor. In the closed position, the flap 26 conceals devices 25 and the channel 27 and contributes to concealing and holding the conductors 31, 32 in place.

The prewiring additive 40 shown in FIGS. 5 and 6 is housed in a recess 27' of the relay box 20. The recess 27' includes two channels located behind a fixed part 26' of the box close to its front face; this part 26' forms the cache that will hide it, such that the channel 27' opens up firstly to face 28 and secondly directly into the recesses of the two relay control terminals 23, through the inside of the box 20. Note that these terminals are therefore accessible through the top and the inside of the box, and through the bottom of the outside of the box. The additive 40 includes two rigid interconnection conductors 41, 42. The conductors 41, 42 are connected at their top by an insulating mounting 43 provided with openings 43*a* through which a tool can be passed to access the contactor power terminals 12; they terminate at the top by two pins 41*a*, 42*a* that will be inserted into the contactor terminals 16 and at the bottom by two pins 41*b*, 42*b* that will penetrate into the two channels of the recess 27' to fit directly into the recesses of the relay control terminals 23, perpendicular to the face 28 of the box 20. The pins may be rigid, or they may be designed to allow an adjustment to the spacing or orientation. In this embodiment, the channels forming the recess 27' also provide guidance when the additive 40 is inserted and they give excellent support to this additive.

The protection relay described can be used to connect flexible individual cables C or cables 31, 32 or rigid conductors 41, 42 forming part of a specific additive 30, 40 while providing the required cache.

What is claimed is:

1. A protection relay for connection to a contactor, comprising:

a relay box (20) having a front face and comprising input power connection terminals and control terminals for connection to corresponding power and control terminals of an adjacent contactor, and manually operable devices located on the front face for actuation or adjustment; and a prewiring accessory (30, 40), wherein the relay box (20) comprises at least one recess (27, 27') setback from the front face for passage therethrough of at least one interconnection conductor (C; 31, 32; 41, 42) for connection between a relay control terminal and a contactor control terminal (16), a cover 26, 26' for masking said at least one recess, and housing part of the prewiring accessory (30, 40) located on the front face, the prewiring accessory comprising the at least one interconnection conductor.

2. The protection relay set forth in claim 1, wherein the relay box (20) further comprises at least one first device (24) with limited access located on the front face, and at least one second device (25) with permanent access located on the front face, and the box has a flap for access to the first device when in the open position and for preventing access when in the closed position, wherein the cover (26) is the flap, the recess (27) being a channel covered by the flap when in the closed position.

3. The protection relay set forth in claim 2, wherein the recess (27) is perpendicular to a top face (28) of the box (20) and adjacent to a contactor, the recess being flared at the top face.

4. The protection relay set forth in claim 1, wherein the cover (26') is fixed to the box and located close to the front face of the box, and the at least one recess (27') comprises at least one channel in the box (20) behind the cover for direct access to pins (41*b*, 42*b*) on the prewiring accessory (40) in housings of the control terminals (23) of the relay.

5. The protection relay set forth in claim 1, further comprising control terminals (23) connected to the prewiring accessory (40), wherein the control terminals (23) are accessible through the top of the box (20) through corresponding internal channels (27') of the box (20) and through the bottom of the outside of the box.

6. The protection relay set forth in claim 1, wherein the at least one interconnection conductor (41, 42) is rigid.

7. A protection relay control set comprising:

a protection relay and a contactor each inside a respective box, the box (10) of the contactor having a contactor front face (14) with a control terminal block (13) mounted thereto, the protection relay box (20) having a top face (28) that is approximately plane and adjacent to the contactor box and a relay front face (24) projecting beyond the contactor front face (14) of the contactor box, with a space (13*a*) between the protection relay and the control terminal block, a recess (27, 27') being behind the relay front face (24) of the relay box for passage of at least one interconnection conductor (C) connecting a control terminal (23) of the relay with a control terminal (16) of the contactor, through the space (13*a*), the recess (27, 27') being concealed in normal service by a cover (26, 26').

8. The protection relay set forth in claim 2, wherein said at least one first device (24) is an actuator or an adjustment device.

9. The protection relay set forth in claim 2, wherein said at least one second device (25) is a stop or reset device.

* * * * *